United States Patent [19]

Nenner et al.

[11] 4,341,602

[45] Jul. 27, 1982

[54] EXTRACTION OF URANIUM USING ELECTROLYTIC OXIDIZATION AND REDUCTION IN BATH COMPARTMENTS OF A SINGLE CELL

[75] Inventors: Thomas Nenner, Chaville; Dominique Foraison, Paris, both of France

[73] Assignee: Rhone-Poulenc Industries, Paris, France

[21] Appl. No.: 65,504

[22] Filed: Aug. 10, 1979

[30] Foreign Application Priority Data

Aug. 17, 1978 [FR] France ..... 78 23950

[51] Int. Cl.[3] ..... C25B 1/00; C01G 43/00

[52] U.S. Cl. ..... 204/1.5; 423/8; 423/9; 423/10

[58] Field of Search ..... 423/8, 10, 9; 204/1.5

[56] References Cited

U.S. PATENT DOCUMENTS

| | | | |
|---|---|---|---|
| 2,790,702 | 4/1957 | McCullough | 423/10 |
| 2,843,450 | 7/1958 | Long | 423/18 |
| 3,616,276 | 10/1971 | Schneider et al. | 423/10 |
| 3,711,591 | 1/1973 | Hurst et al. | 423/10 |
| 3,737,513 | 6/1973 | Wiewiorowski et al. | 423/8 |
| 3,770,612 | 11/1973 | Gray et al. | 204/1.5 |
| 3,869,374 | 3/1975 | Goldacker et al. | 423/8 |
| 4,021,313 | 5/1977 | Hausberger et al. | 204/1.5 |
| 4,234,393 | 11/1980 | Hepworth et al. | 204/1.5 |

OTHER PUBLICATIONS

Merritt, "The Extractive Metallurgy of Uranium", pp. 237–239, Colorado School of Mines Research Institute, (1971).

*Primary Examiner*—Edward A. Miller

*Attorney, Agent, or Firm*—Burns, Doane, Swecker & Mathis

[57] ABSTRACT

The invention relates to a process for the recovery and the concentration of uranium (VI) contained in an organic phase. The organic phase is treated continuously in a contact zone with an aqueous solution containing an oxidizing-reducing agent in the reduced state, said oxidizing-reducing agent being capable of reducing $U^{+6}$ to $U^{+4}$ in said aqueous solution. The aqueous solution employed in the process issues in part or in its entirety from the cathodic compartment of an electrolytic separation cell, which is under a direct current potential, and the aqueous phase issuing from the contact zone feeds in part or in its entirety the anodic compartment of the electrolytic cell. The process is of particular interest when applied to the recovery and concentration of uranium contained in a wet process phosphoric acid.

41 Claims, 5 Drawing Figures

EXTRACTION OF URANIUM USING ELECTROLYTIC OXIDIZATION AND REDUCTION IN BATH COMPARTMENTS OF A SINGLE CELL

BACKGROUND OF THE INVENTION

1. Field of the Invention

The present invention relates to a process for the recovery of uranium contained in an organic phase. More particularly, the invention concerns the concentration and purification of uranium extracted from a wet process phosphoric acid, i.e. from phosphoric acid produced by the acidulation of phosphate rock.

2. Discussion of the Prior Art

Phosphate rock naturally contains small amounts of uranium (from about 50 to 400 p.p.m.). The uranium is dissolved during acidulation of the phosphate rock and remains in the phosphoric acid solution thus produced. Although the concentration of urnaium in such solutions is low, the wet-process phosphoric acid is a valuable source of uranium because of the vast quantities of phosphate rock mined each year and processed to recover high-phosphate-containing fertilizer.

A number of attempts have been made in the past to develop commerically feasible methods of recovering uranium from such aqueous solutions. Thus, it is known to recover uranium from aqueous solutions in which it is present in low concentrations, by separating the other potentially usable components of the minerals treated by means of a liquid-liquid extraction assembly and by chemical treatment for the purpose of isolating the uranium and recovering it in the form of a high purity $U_3O_8$ oxide, usable as a source of nuclear fuel. These processes are applicable to the recovery of uranium from minerals such as phosphate rock, which also yields phosphoric acid, and from minerals of various origin containing more or less uranium, which is present most frequently in the form of oxides. The prior art processes generally comprise treatment of the mineral with the aid of a strong and concentrated acid, such as sulfuric, phosphoric, hydrochloric or nitric acid, to provide an aqueous solution containing uranyl ions in a highly dilute state, together with other contaminating ions, from which the uranium is then recovered. A typical example of the treatment of such a solution from a raw, wet process phosphoric acid, obtained by the attack of surfuric acid on phosphate rocks, is described by F. J. Hurst & D. J. Crouse in *Ind. Eng. Chem. Process Des. Develop.* Vol. 11, No. 1, 1972, pp. 122–128. See also Hurst et al. U.S. Pat. No. 3,711,591 and Wiewiorowski et al. U.S. Pat. No. 3,737,513 for descriptions of various prior art attempts.

According to the Hurst and Crouse process described in the aforementioned *Ind. Eng. Chem. Process Des. Development* publication, the solution in which uranium is found or in which it is transformed to the $U^{+6}$ state, is exposed to a first uranium extraction cycle employing an organic solvent consisting of a mixture of synergistic extracts, namely di-(2-ethylhexyl)-phosphoric acid (designated HDEHP or D2EHPA) and trioctylphosphine oxide (designated TOPO), diluted in a kerosene-type hydrocarbon. The uranium is extracted from the aqueous solution into the organic solvent in the form of a uranyl complex formed between the uranium (VI) $UO_2^{+2}$ ions and the synergistic mixture of the extractants. The uranium is subsequently recovered from the organic phase into which it has been extracted by means of contact with an aqueous solution of phosphoric acid containing sufficient iron (II) ions to reduce the uranium (VI) to uranium (IV). Because the quadrivalent state is less extractable, the uranium is transferred to the aqueous phase. This aqueous phase is then reoxidized to return the uranium to the uranium (VI) state of oxidation and is then exposed to a second extraction cycle using an organic phase containing a synergistic mixture of he HDEHP-TOPO extractants to obtain finally, after the re-extraction of uranium with an ammonium carbonate solution, a sufficiently pure mixed uranium and ammonium carbonate.

The prior art process described above has a number of disadvantages at the industrial level. Specifically, the reducing re-extraction in the first cycle requires the addition of iron (II) ions which are obtained by the action of phosphoric acid on iron, which is a slow and difficult reaction, or by means of the introduction of an iron (II) salt, which implies the introduction of an additional anion. In any case, this operating method has the disadvantage of introducing an appreciable amount of iron into the phosphoric acid, which seriously interferes with the second uranium purification cycle downstream. Furthermore, since this second extraction cycle is to be effected in the oxidized aqueous solution, treatment with an oxidizing agent is necessary. Again, there are attendant difficulties. Thus, if the oxidation is performed with air, the operation is slow and requires additional equipment. If oxidation is effected by means of a chemical oxidant, it involves the introduction of harmful foreign ions; for example, the introduction of chlorate ions results, after reduction, in the formation of chloride ions, which are powerful corroding agents. The use of oxygenated water (another possible oxidant) is expensive.

BRIEF SUMMARY OF THE INVENTION

The process of the present invention comprises the continuous treatment in a contact zone of an organic phase containing a uranyl complex formed between the ions of uranium (VI) $UO_2^{+2}$ and an extracting agent or a mixture of extracting agents immiscible with water (said organic phase optionally containing an excess of the extracting agent or a mixture of extractants not complexed with uranium, and/or optionally diluted with an inert organic solvent immiscible with water), with an aqueous extracting solution containing an oxidizing-reducing agent in the reduced state, said oxidizing-reducing agent being a reducing agent for uranium (VI) to uranium (IV) in said aqueous solution, to reduce and extract the uranium in the form of $U^{+4}$ ions, followed by separation of the organic phase depleted in uranium and the aqueous phase charged with uranium, said process being characterized in that:

(1) said aqueous extracting solution issues entirely or in part from the cathodic compartment of an electrolytic separation cell under a direct current potential;

and (2) said aqueous phase originating in said contact zone and containing uranium feeds in its entirety or in part the anodic compartment of said electrolytic separation cell under a direct current potential, to afford an aqueous product containing a concentration of uranium substantially in the form of $U^{+6}$ and also containing the oxidizing-reducing agent in its oxidized state.

DETAILED DESCRIPTION OF THE PREFERRED EMBODIMENTS

Figure 1:
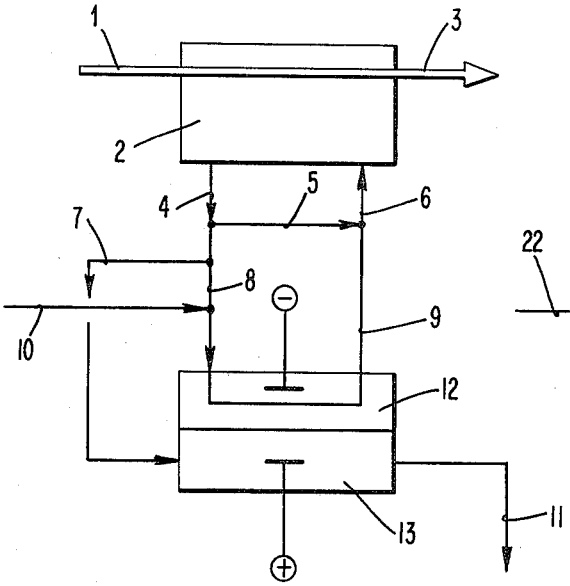
FIG. 1 is a schematic diagram of a principal mode of embodiment of the invention, which can include several variations discussed hereinbelow, and which comprises a single contact zone and an electrolytic element or a battery of electrolytic elements.

In accordance with the present invention, the initial organic phase employed in the instant process contains an extracting agent for uranium (VI), which, however, extracts few uranium (IV) ions. This type of extractant is well known in the art. Suitable extractants include cationic extractants, among which the following may be cited as examples, but without limiting the group: select monoalkylphosphoric acids, dialkylphosphoric acids, alkylphosphonic acids, alkylphenylphosphoric acids, alkylphosphinic acids, and alkylpyrophosphoric acids, used individually or in mixtures, wherein the alkyl chains generally contain 4 to 10 carbon atoms. Alternatively, the extractant as defined above may be associated with a known synergistic extraction agent, such as, for example, the alkylphosphates, alkylphosphonates, alkylphosphinates or trialkylphosphine oxides, wherein the alkyl chains generally contain 4 to 10 carbon atoms. Among synergistic couples well suited to the extraction of uranium from phosphoric acid, the mixture of di-(2-ethylhexyl)-phosphoric acid with trioctylphosphine oxide, may be mentioned as an example. The extractant may further contain anionic extractants, such as certain secondary or tertiary alkylamines which are insoluble in water, and certain known extracting agents which are of a neutral character and which are also immiscible in water, such as trialkyl phosphates.

The organic phase can optionally contain an organic diluent which is inert with respect to the extractants, so as to improve the hydrodynamic properties of the organic phase. Numerous organic solvents or their mixtures may be used as diluents, for example aliphatic hydrocarbons such as kerosene, aromatic hydrocarbons, halogenated hydrocarbons, petroleum ethers and the like. In general, the characteristics of the inert diluent are not critical, although select diluents offer certain advantages under particular conditions of utilization.

The concentration of the extracting agent in the diluent may vary within large limits, i.e. between about 0.05 mole and the pure extractant. However, from a practical point of view, extractant solutions comprising between 0.1 and 2 molar, are generally employed. In the case where an extractant is used together with a synergistic extracting agent, the solution will usually be 0.1 to 2 molar in the extractant and 0.01 to 2 molar in the synergistic agent. The initial organic phase contains the uranium in the (VI) state of oxidation, as the result of the conditions of preparation of this solution. It also contains other chemical species, depending on the conditions of preparation. Specifically, in the case of solutions obtained by the liquid-liquid extraction of a raw, wet process phosphoric acid, the solutions usually contain phosphoric acid and other anions and cations of metals such as Al, Fe, Ti, V, etc., in the slightly concentrated state. The uranium concentration of the organic phase is generally between 20 and 3000 mg, expressed as uranium metal per liter of the phase, preferably between 50 and 500 mg per liter.

The aqueous solution which is placed in contact with the above-mentioned organic phase generally contains a strong and complexing acid, such as phosphoric or hydrochloric acid, and possibly other acids and their mixtures, provided that the presence of the acids does not lead to the precipitation of uranium. The aqueous solution also contains an oxidizing-reducing agent capable of reducing uranium (VI) to uranium (IV), said agent being in the reduced state. The electrochemical potential of the oxidizing-reducing couple mentioned hereinabove in the aqueous solution under consideration is such that it is lower than that of the uranium (VI)-uranium (IV) couple in said solution. A representative oxidizing-reducing couple is an iron (III)/iron (II) couple. Thus, when an iron (III)/iron (II) couple is used, the aqueous solution contains iron in the +2 oxidation state. In order to displace the equilibrium of the reaction between the $U^{+6}$ ions and the $Fe^{+2}$ ions on the one hand, and the $U^{+4}$ and $Fe^{+3}$ ions on the other, in a direction favorable to the production of $U^{+4}$ ions, the solution must contain a significant excess of iron (II) ions with respect to the uranium ions. The concentration of the strong acid in the solution may vary between wide limits. However, in actual practice, in order to obtain the maximum depletion of uranium in the organic solution, the concentration will be selected as a function of the specific phases used and of the temperature. In the case wherein the strong and complexing acid of the aqueous solution is phosphoric acid, its concentration in the solution should be between 18 and 70%, preferably higher than 35% by weight of $P_2O_5$. The solution may also contain iron ions in the +3 oxidation state, in which case the ratio of the concentration in iron (II) ions to the concentration of iron (III) ions may vary between very broad limits. In actual practice, a ratio of $Fe^{+2}$ to $Fe^{+3}$ in excess of 0.1 is usually indicated, although preferably the ratio of $Fe^{+2}$ to $Fe^{+3}$ should be higher than 10.

The organic phase containing uranium in the +6 oxidation state and the aqueous solution described hereinabove are contacted with each other in conventional liquid-liquid extraction equipment. The contacting may be effected in mixer-decanters, in packed or pulsating columns, or in any other suitable apparatus, the contact being concurrent or countercurrent. The temperature during the contacting is not critical, but for practical reasons temperatures between 20° C. and 80° C., preferably in the vicinity of 50° C., are preferred.

The ratio of the flow rate of the organic phase to that of the extracting aqueous solution entering the contact zone is not critical; however, the ratio should be maintained as high as possible in order to recover uranium in the form of a concentrated solution. A flow ratio of organic phase to aqueous solution of between 20 and 50 leads to the best results. This range of values does not, however, take into account internal recycling within the extraction zone.

In the course of the contacting process according to the present invention, it is thought that the equilibrium of the partition of uranium (VI) between the organic phase and the aqueous solution is established rapidly, while the reduction of uranium (VI) in the aqueous solution by the reducing agent is slow. Knowledge of he kinetics of the reduction and the isotherms of the partition of $U^{+6}$ and $U^{+4}$ permits the control of the different parameters of the contacting process to obtain maximum extraction results.

The aqueous phase issuing, after separation, from the contact zone and containing the $U^{+4}$ ions and the oxidizing-reducing agent in a partially oxidized state, is preferably divided into two streams, each feeding a compartment of an electrolytic cell which is under a direct current potential (voltage). The first of the two streams feeds the cathodic compartment of said cell under direct current potential, whereby the oxidizing-reducing agent is electrolytically reduced. Thus, in the case of the use of iron (III)/iron (II) couple as the reducing-oxidizing agent, the iron (III) ions are reduced to iron (II) ions. Subsequently, this first stream again feeds into the contact zone with the above defined organic phase, thus forming a closed circulation loop. After the derivation of the first stream, but prior to its introduction into the cathodic compartment of the electrolytic cell, an aqueous solution preferably containing the strong, complexing acid, and also containing ions of the oxidizing-reducing couple in amounts corresponding to those withdrawn in the second stream, is added to said first stream, in order to place the material balance in equilibrium. In the specific case of the application of the present process to the treatment of an organic phase containing uranium (VI) and originating in the extraction of a raw, wet process phosphoric acid, the aqueous solution added to the first derived stream comprises phosphoric acid at a concentration equivalent to that of the aqueous solution circulating in the preceding loop. In the case in which iron (III)/iron (II) is used as the oxidizing-reducing couple, the iron of the added solution may be in the form of $Fe^{+2}$ or $Fe^{+3}$ ions and may come from the iron present in the phosphoric acid, or from an iron (II) salt or an iron (III) salt added to said solution, or from the attack of phosphoric acid on iron.

The second derived stream feeds the anodic compartment of the electrolytic separation cell under a direct current potential (voltage). Because the intensity in the two compartments is equal, the resultant aqueous phase, which contains a uranium concentration substantially in the form of $U^{+6}$ and also contains the oxidizing-reducing agent in the oxidized state, is recovered; this constitutes the desired product or production solution. This product, i.e. the aqueous phase issuing from the anodic compartment with a high concentration of uranium at the +6 oxidation level, is exposed to subsequent physical and chemical treatments, which are not part of the present invention, in order to recover the uranium.

The electrolytic cell used in practicing the process of the present invention is a known separator cell. As the separator, a porous material such as a ceramic or a plastic material rendered porous by sintering or by the introduction of a porogen agent, or an ion exchange membrane, may be used. A preferred separator is a cation exchange membrane, preferably consisting of a perfluorated polymer with sulfonic acid groups. The anode generally consists of graphite or a metal coated with an electroactive layer, such as a Ti/precious metal alloy couple. The cathode may consist of different metals, for example, platinum, lead or a Ti/precious metal alloy couple. The configuration of the cell is generally of the flat type, with a large electrode surface and a narrow space between the electrodes. In a preferred form of industrial embodiment, a battery of electrolytic elements mounted in series in a multicell device of a known filter press type is used. In this form of embodiment, the input of the cathodic compartments may be effected in parallel or in series, so as to control the flow of liquid into each of the elements. In order to facilitate the desired electrochemical reactions, it may be advantageous to increase the active surface of the electrodes or to cause vigorous agitation of the solutions by means of a set of baffles. Similarly, the feed of the anodic compartments may be of series or of parallel type. Furthermore, in order to equalize the pressures of the two compartments, the anodic compartment may comprise means to recycle the exiting solution.

The invention will be better understood with reference to the accompanying drawings, discussed in detail below.

In FIG. 1, the circulation of the liquid flows is illustrated according to the principal mode of embodiment of the invention. By means of flow 1, an organic phase containing the extractant, uranium at the +6 level of oxidation, and optionally including an inert organic diluent, is introduced into a liquid-liquid contact zone 2. By means of flow 6, an aqueous extraction solution containing the oxidizing-reducing agent in the reduced state, is also introduced. Following decantation of the phases, an organic phase 3 depleted of uranium and a flow 4 of the aqueous phase containing $U^{+4}$ and the oxidizing-reducing agent, now partially oxidized, issue from zone 2. A portion of flow 4 is divided into a flow 5 which is added to flow 6 to constitute a recycle loop. The residual flow is in turn divided into two flows, 7 and 8. Flow 8 feeds the cathodic compartments of a battery of electrolytic cells represented schematically by 12 and flow 7 supplies the anodic compartments 13 of said battery. Further, a flow 10 is added to flow 8, said flow 10 consisting of an aqueous solution containing the oxidizing-reducing agent. A flow 9 issues from the cathodic compartments, which, after combining with flow 5, constitutes the aqueous solution entering into contact zone 2. From the anodic compartments, there issues an aqueous solution which is passed to storage, not shown, and which may contain the complexing acid in addition to uranium concentrated substantially in the form of $U^{+6}$ and the oxidizing-reducing agent in the oxidized state. This aqueous solution, which is the desired product, is then treated to recover the uranium.

In a first variation, not shown, of the principal mode of embodiment, the mode shown in FIG. 1 is modified such that the entire flow 4 is passed into the anodic compartments 13. Because of this, flows 5 and 8 are zero, while the cathodic compartments 12 are supplied continuously only by a fresh aqueous solution, which may contain the complexing acid and the oxidizing-reducing couple.

In a second variation, not shown, of the mode depicted in FIG. 1, streams 5 and 8 are not zero and stream 10 is introduced into stream 8 to form, after combining with stream 5, the flow of the aqueous solution supplying zone 2. It should be understood that in the case of the use of the iron (II)/iron (III) couple, the solution 6 must satisfy the conditions described hereinabove concerning the iron (II)/iron (III) ratio and the reducing power of the solution. In this case, only the derived flow 8 feeds the cathodic compartments 12 to undergo reduction of the iron (III) ions.

In an optional third variation, not shown, of the mode illustrated by FIG. 1, the aqueous solution 11, which is the product issuing from the anodic compartments and which contains $U^{+6}$, may be treated with a very slight amount of a chemical oxidant, such as oxygenated water, in order to effect during storage the transformation of $U^{+4}$ to $U^{+6}$ ions, but in any case, the amount of the chemical oxidant added represents a very slight fraction, preferably of the order of a few percent, of the quantity of oxygen which would be necessary to achieve the total oxidation of uranium and of the oxidizing-reducing agent by chemical means without using the process of the invention.

Figure 2:
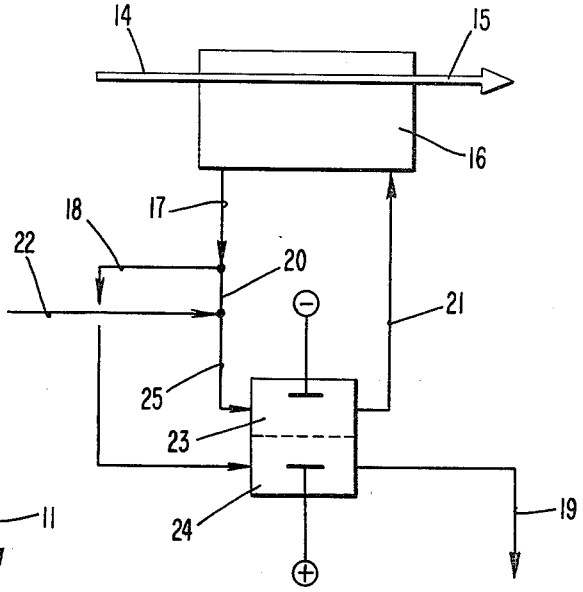
FIG. 2 is a schematic diagram of another mode of embodiment of the invention comprising a single contact zone and a battery of elements.

With reference to FIG. 2, another form of embodiment comprising a contact zone and an electrolytic battery is illustrated. For the purpose of simplification in the following discussion, the aqueous solution for the contact extraction comprises a strong, complexing acid and an oxidizing-reducing agent consisting of iron ions. However, it should be understood that it is possible to use another oxidizing-reducing agent, provided that it satisfies the above specified conditions. According to the embodiment shown in FIG. 2, an organic phase containing the extractant, $U^{+6}$ and, optionally, an inert, organic diluent, is introduced through 14 into contact zone 16. By means of flow 21 an aqueous solution of the complexing acid containing iron (II) is also introduced. After decantation of the phases, a flow of the organic phase 15, depleted of uranium, and an aqueous phase 17 containing $U^{+4}$, $Fe^{+2}$ and $Fe^{+3}$, issue from zone 16. Flow 17 is divided into two flows, 18 and 20. Flow 18 supplies the anodic compartments of a battery of electrolytic elements schematically shown by 24 and exits by means of the flow 19, which is the production flow and which contains the complexing acid, uranium concentrated substantially in the form of $U^{+6}$ and iron in the form of $Fe^{+3}$, said production flow being passed to storage to undergo subsequent treatments. Flow 20 is added to flow 22, consisting of an aqueous solution of the complexing agent and iron ions. The combined flow 25 supplies the cathodic compartments of a battery of electrolytic elements shown schematically by 23. Flow 21 issues from the cathodic compartments 23 in the reduced state and supplies the contact zone 16. Again, optionally, a very slight amount of a chemical oxidizing agent may be added to the production flow 19.

Figure 3:
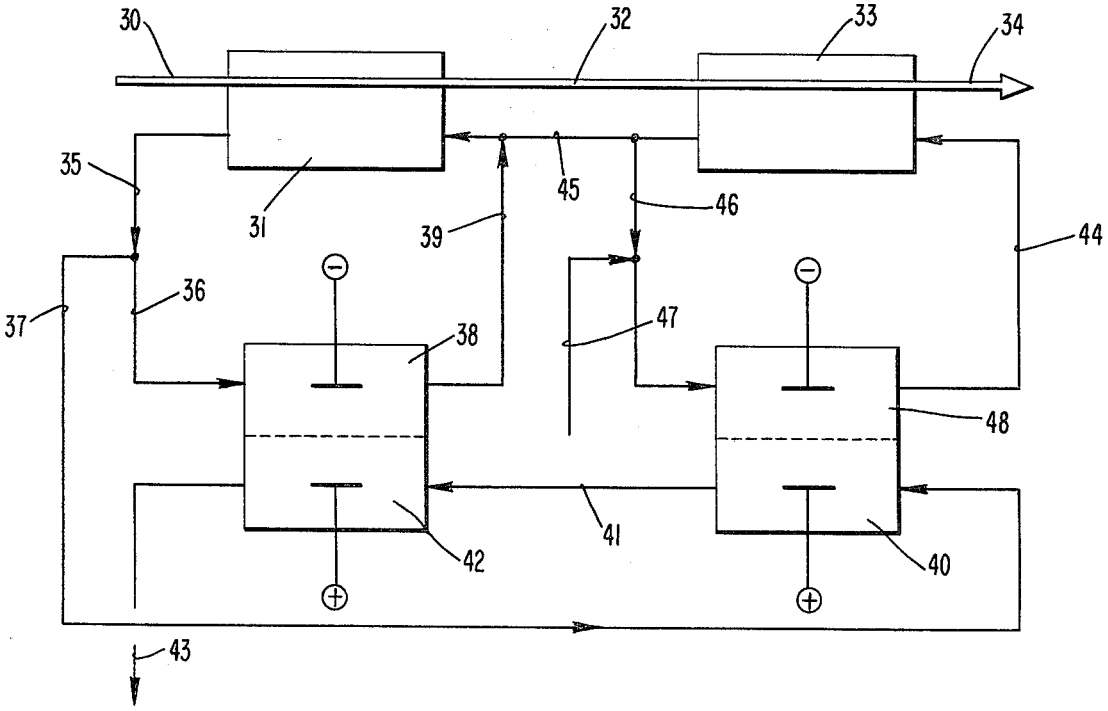
FIG. 3 is a schematic diagram of a mode of embodiment of the invention comprising two contact zones and two batteries of electrolytic elements with combined flows.

FIG. 3 illustrates a mode of embodiment comprising the utilization of two contact zones and two batteries of electrolytic elements. By means of stream 30, an organic phase containing the extractant, uranium (VI) and, optionally, an inert organic diluent, is introduced into a first contact zone 31. The organic phase partially depleted in uranium issues from said first contact zone by the flow 32 which supplies a second contact zone 33. After separation of the phases, the organic phase depleted in uranium exits by means of flow 34. Via combined flows 39 and 45, to be explained hereinafter, an aqueous solution comprising the complexing acid, iron ions and a slight proportion of uranium (IV) ions, is also introduced. Following the contact and the separation of the phases in zone 31, an aqueous phase 35 containing uranium (IV), iron (II) and iron (III) is withdrawn. This flow is then divided into two streams, 36 and 37. Stream 37 supplies the cathodic compartments of a first battery of electrolytic elements schematically represented by 38. This stream, after reduction, constitutes the flow 39 which partially feeds the first contact zone 31. Stream 37 successively supplies first the anodic compartments of a second battery of electrolytic elements represented schematically by 40 and then, by means of flow 41, the anodic compartments 42 of the above-mentioned first battery of electrolytic elements. A flow 43 issues from the anodic compartments 42 of the first battery. Flow 43 constitutes the production flow and is passed to storage, not shown. In the second contact zone 33, the flow 32 of the organic phase is contacted with an aqueous solution 44 containing the complexing agent, iron (II) and iron (III) and a slight proportion of uranium (IV). Following the separation of the phases, an aqueous phase is withdrawn from the zone 33, said aqueous phase being divided into a flow 45 supplying, together with the flow 39 described hereinabove, the first contact zone 31; and a flow 46 which, after the addition of a fresh solution containing the complexing acid and iron ions via 47, supplies the cathodic compartments 48 of the above-mentioned second battery of electrolytic elements. It should be understood that, in this embodiment and flow sheet, the material balance requires that the amounts of the complexing acid and of iron entering by flow 47 be equal to those exiting in the production flow 43.

Figure 4:
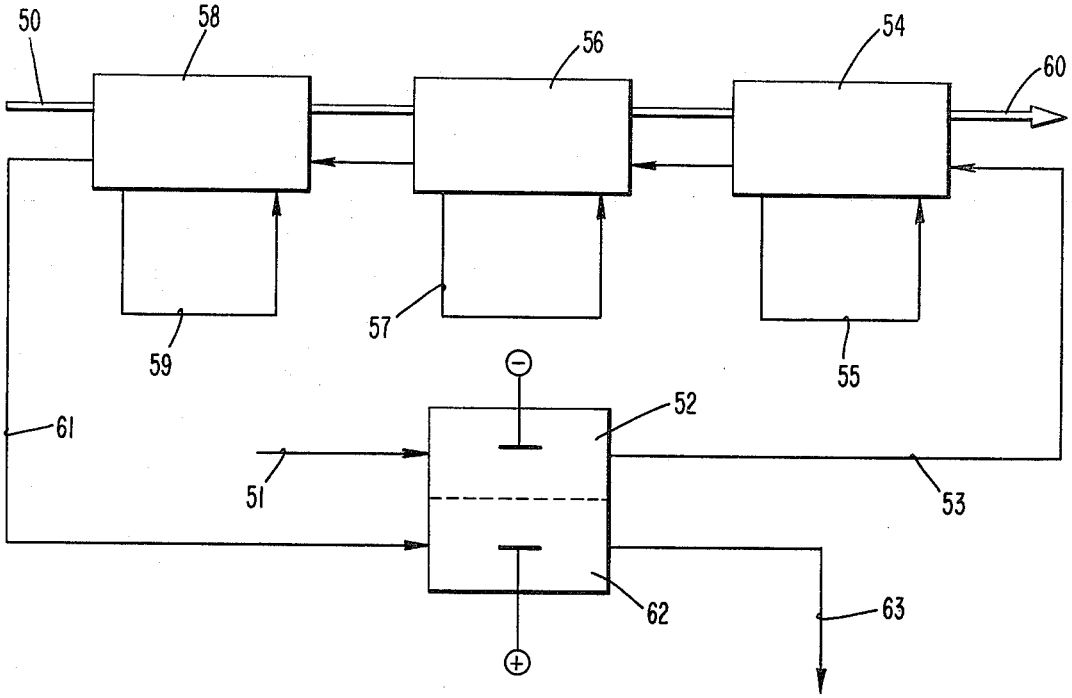
FIG. 4 is a schematic diagram of a mode of embodiment of the invention comprising three contact zones and a single battery of electrolytic elements.

FIG. 4, which represents yet another mode of embodiment of the invention, comprises several contact zones and a single battery of electrolytic elements. The initial organic phase is represented by flow 50, which is successively contacted in the zones 58, 56 and 54 with an aqueous solution as will be explained hereinafter. After separation, the phase depleted in uranium exits from zone 54 by means of flow 60. By means of stream 51, an aqueous solution is further introduced, said aqueous solution comprising the complexing acid and the iron ions. This solution supplies the cathodic compartments 52 of a battery of electrolytic elements. The reduced flow 53 exiting the cathodic compartments successively supplies the aqueous phase to a first contact zone 54, then, after the separation of the phases, to a second contact zone 56 and finally to a third contact zone 58, in the order of contact of 54, 56, 58, while the initial organic phase is placed into contact in the successive order of 58, 56, 54. In each of the contact zones 54, 56 and 58, consisting of three batteries of mixer-decanters, a fraction of the aqueous phase is taken from the final mixer-decanter in the direction of circulation of the aqueous phase, and is reintroduced into the first mixer-decanter of the same battery in the form of the flows 55, 57 and 59. An aqueous phase 61 issues from the third contact zone 58, said aqueous phase being enriched in uranium (IV); flow 61 is passed in its entirety to the anodic compartments 62 of the battery of electrolytic elements, from which an aqueous flow 63 enriched in uranium (VI) is recovered, said flow 63 constituting the production solution and being passed to storage, not shown.

As in the preceding modes of embodiment, the mode depicted in FIG. 4 may comprise the optional treatment of the production solution with a very slight amount of a chemical oxidizing agent.

Figure 5:
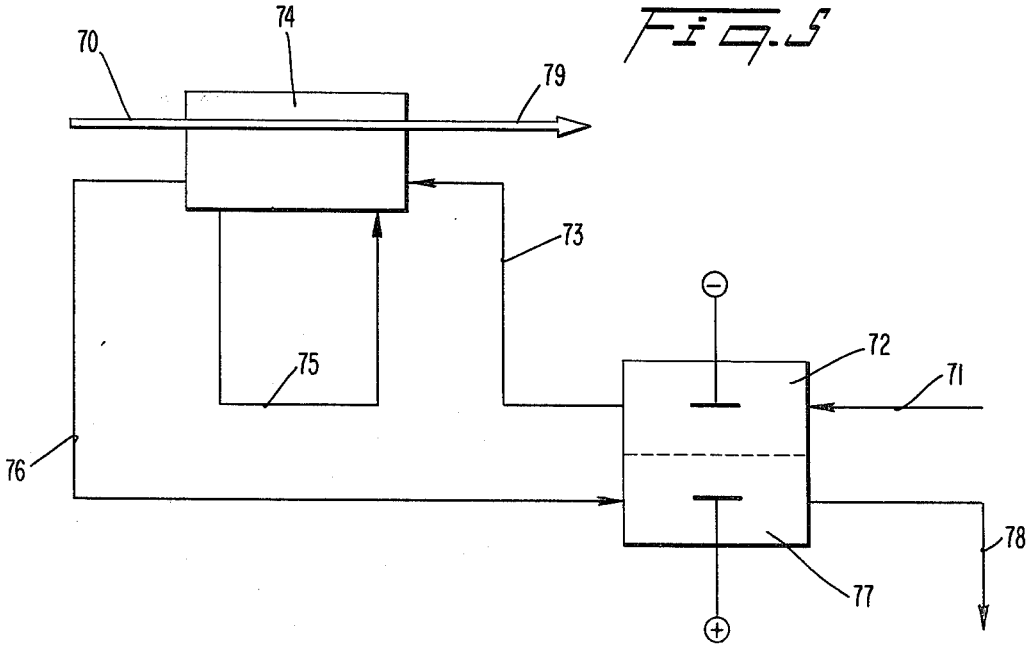
FIG. 5 is a schematic diagram of a variation of the mode of embodiment of the invention employing a single contact zone and one battery of electrolytic elements.

FIG. 5 represents a variation of the mode of embodiment of the invention utilizing a single contact zone and one battery of electrolytic elements. The organic phase charged with uranium and represented by the flow 70 is introduced into the contact zone 74. The organic phase, depleted of uranium, is removed after decantation by the flow 79. An aqueous solution of the complexing acid containing iron (II) is also introduced into this zone via 73; said aqueous solution issues from the cathodic compartments 72 of a battery of separated electrolytic elements, these compartments being fed by flow 71 with a fresh solution of complexing acid and of iron ions. After contact and decantation in contact zone 74, at the outlet of the zone an aqueous phase 76 charged with uranium is recovered. In contact zone 74, consisting of an assembly of mixer-decanters, a derived flow 75 is withdrawn from the last mixer-decanter and is reintroduced into the first mixer-decanter of said battery to form a recycle loop, 75–74. Flow 76 feeds the anodic compartments 77 of said battery of electrolytic elements. Flow 78 exiting from the anodic compartments constitutes the production solution. This flow, enriched in uranium (VI), is passed to storage for future treatment. As in the preceding modes of embodiment, the mode of embodiment of FIG. 5 may optionally include the treatment of the production flow with a very slight amount of a chemical oxidizing agent.

The advantages offered by the instant process include reduced energy consumption for the oxidation and reduction in comparison with the amount of energy consumed in separate cells and, consequently, a corresponding reduction in cost. Furthermore, the process avoids the introduction of foreign ions and, in the case of the use of iron as the oxidizing-reducing agent, the iron content in the production solution is limited to a concentration acceptable in a simple recovery of high purity uranium, as compared with the prior art.

The invention will appear more fully from the examples which follow. These examples are given by way of illustration only and are not to be construed as limiting the invention either in spirit or in scope as many modifications both in materials and in methods will be apparent to those skilled in the art. In these examples, percentages are by weight, unless otherwise indicated.

EXAMPLE 1

This example illustrates the mode of embodiment of the invention represented by FIG. 2.

At 14, an organic phase comprising kerosene as the inert organic diluent is introduced. The phase has a 0.5 molar concentration of di-(2-ethylhexyl)phosphoric acid and a 0.125 molar concentration of trioctylphosphine oxide and further contains 190 mg/liter uranium (VI) ions. The flow rate of the phase is 5 liters per hour. The organic phase is contacted at 50° C. in zone 16, which consists of a mixer-decanter, with an aqueous solution 21 with the following composition:

| | |
|---|---|
| phosphoric acid: | 35% expressed in $P_2O_5$ |
| $Fe^{+3}$: | 0.85 g/liter |
| $Fe^{+2}$: | 7.15 g/liter |
| $U^{+4}$: | 6.62 g/liter |

having a flow rate of 5.00 liter per hour. After decanting, the aqueous phase 17 is divided into a flow 20 with a flow rate of 4.87 liter per hour and a flow 18 with a flow rate of 0.13 liter per hour.

To the flow 20, a flow 22 is added, said flow 22 consisting of an aqueous solution of phosphoric acid with 35% $P_2O_5$, containing 8 g/liter of iron in the ferric form, and having a flow rate of 0.13 liter per hour. The resulting flow 25 feeds the cathodic compartment 23 of an electrolytic cell having a membrane consisting of the perfluorated sulfonic polymer NAFION (commercial mark of DuPont de Nemours). The electrolytic cell comprises two compartments of the dimensions of 7×20 cm with flat electrodes, the anode being of graphite and the cathode of lead. The distance of the cathode from the membrane is 3 mm and that of the anode from the membrane is also 3 mm. The anodic compartment 24 is equipped with staggered baffles increasing the path of the electrolyte and enhancing its velocity. A direct electric current of 1 ampere is applied to the cell, with a potential at the terminals of 2 volts.

The organic phase 15, after extraction, contains 18 mg/l uranium. The flow 18 supplies the anodic compartment 24 of the electrolytic cell. A solution 19 of phosphoric acid with 35% $P_2O_5$ is recovered, containing the following ions:

| | |
|---|---|
| $Fe^{+3}$: | 8 g/liter |
| $U^{+6}$: | 5.94 g/liter |
| $U^{+4}$: | 0.68 g/liter |

The consumption of electric energy in the electrolytic cell required to treat 1 kg of uranium is 2 KW per hour.

EXAMPLE 2

This example illustrates the mode of embodiment according the FIG. 3.

The temperature is maintained at 50° C. in the entire apparatus. By means of flow 30, an organic phase containing kerosene as the inert organic diluent is introduced. The phase has a 0.5 molar concentration of di-(2-ethylhexyl)phosphoric acid and a 0.125 molar concentration of di-(2-ethylhexyl)phosphoric acid and a 0.125 molar concentration of trioctylphosphine oxide and further contains uranium (VI) ions at a concentration of 230 mg/liter. The flow rate of the organic phase is 5 liters per hour and its temperature is 50° C.

At 47, a flow of a fresh aqueous solution of phosphoric acid with 34% $P_2O_5$ and heated to 50° C. is introduced; it contains 9 g/liter of iron in the ferric form and flows at a rate of 0.15 liter/hour. The organic phase 30 is contacted in zone 31 with an aqueous solution representing the combination of two flows, the first of the two flows being the stream 39 with a flow rate of 5 liters per hour and the following composition:

| | |
|---|---|
| $H_3PO_4$: | 34% expressed as $P_2O_5$ |
| $Fe^{+2}$: | 7.9 g/liter |
| $Fe^{+3}$: | 1.1 g/liter |
| $U^{+4}$: | 7.6 g/liter |

and the second of the two flows being flow 45, to be explained hereinafter.

At the outlet of the contact zone 31, an aqueous flow 35 is recovered; it is divided into two flows, 36 and 37. The stream 37, at a flow rate of 0.15 liter/hour, supplies the anodic compartment 40 of a second electrolytic cell of the design of that of Example 1, while the stream 36 feeds the cathodic compartment 38 of a first cell. A current of 0.40 ampere is applied to the terminals of the first cell. Flow 37, after having traversed the anodic compartment 40 of the second cell at a current intensity of 0.75 ampere, is introduced via stream 41 into the anodic compartment 42 of the first cell, from which it issues in the form of the flow 43 at a rate of 0.15 liter/-hour with the following composition:

| | |
|---|---|
| $H_3PO_4$: | 34% expressed as $P_2O_5$ |
| $Fe^{+3}$: | 9 g/liter |
| $U^{+6}$: | 7.4 g/liter |
| $U^{+4}$: | 0.2 g/liter |

Flow 43 is the production solution and is passed to storage, not shown. The flow of the organic phase 32 issuing from the first contact zone 31 subsequently enters a second contact zone 33 consisting of a mixer-decanter. There, the organic phase is contacted with an aqueous solution 44 flowing at a rate of 5 liter/hour, and having the following composition:

| | |
|---|---|
| $H_3PO_4$: | 34% expressed as $P_2O_5$ |
| $Fe^{+2}$: | 7.9 g/liter |
| $Fe^{+3}$: | 1.1 g/liter |
| $U^{+4}$: | 0.38 g/liter |

The organic phase issuing from the second contact zone 33 has a uranium concentration of 2 mg/liter. The aqueous phase issuing from contact zone 33 is divided into two flows, the first, 45, being combined at a rate of 0.15 liter/hour with the flow 39 to feed the first contact zone 31, while the second, 46, flowing at a rate of 5 liter/hour, absorbs the above-mentioned fresh flow 47 and then feeds into the cathodic compartment 48 of the second electrolytic cell. The reduced flow 44 issues from the cathodic compartment 48 and feeds into the second contact zone 33. The amounts of phosphate and iron ions introduced at 47 are equal to those issuing in the production flow 43.

EXAMPLE 3

This example illustrates the mode of embodiment of the invention represented by FIG. 4.

Through line 50, an organic phase consisting of kerosene containing di(2-ethylhexyl)phosphoric acid at a concentration of 0.5 mole, and having a 0.125 molar concentration of trioctylphosphine oxide and 120 mg/l of $U^{+6}$ ions is introduced. The flow rate of the organic phase is 8 liter/hour and the temperature in the entire apparatus is 50° C.

Through line 51, there is introduced an aqueous solution of phosphoric acid having 33% $P_2O_5$ at 50° C. and containing 18 g/liter of $Fe^{+3}$ ions and 12 g/liter of $Fe^{+2}$ ions, at a rate of 0.20 liter/hour, into the cathodic compartment 52 of an electrolytic cell identical with that of Example 1, the intensity of the electric current being 2.5 amperes. The issuing aqueous solution 53 contains:

| | |
|---|---|
| $Fe^{+3}$: | 2 g/liter |
| $Fe^{+2}$: | 28 g/liter |

The aqueous solution is passed in countercurrent to the organic phase successively to three mixer-decanters 54, 56, 58, which are provided with the respective recirculations 55, 57, 59, having flow rates of 4 liter per hour. The aqueous phase 61 issuing from the third contact zone 58 is passed to the anodic compartment of the electrolytic cell at a rate of 0.2 liter/hour. The aqueous phase 63 issuing from the anodic compartment and constituting the production solution contains 30 g/liter Fe (III) ions and 4.76 g/liter uranium ions, 4.2 g/liter of which are in the form of $U^{+6}$.

EXAMPLE 4

This example illustrates the mode of embodiment of the invention represented by FIG. 5. The temperature is 55° C. in the entire apparatus.

Via line 70, a solution of kerosene containing 0.5 mole/l di(2-ethylhexyl)phosphoric acid, 0.125 mole/l trioctylphosphine oxide and 150 mg/l $U^{+6}$ ions, is introduced into contact zone 74. The flow rate is 4 liters per hour, the temperature 55° C. In the cathodic compartment 72 of a cell identical with those described hereinabove in Example 1, 0.1 liter per hour of a solution of phosphoric acid with 37% $P_2O_5$ at 55° C., is introduced via line 71, said solution containing 30 g/l iron ions introduced in the form of the sulfate, 20 g/l of which are in the form of $Fe^{+3}$. The current intensity applied is 1.0 ampere.

The solution in line 73 issuing from the cathodic compartment contains 28 g/l ferrous ions and is contacted with the organic phase 70 in the mixer-decanter 74, which is equipped with an internal circulation 75 having a flow rate of 3 liters per hour. The organic phase issuing via 79 contains 15 mg/l of uranium.

The aqueous solution 76 leaving the mixer-decanter 74 is introduced into the anodic compartment 77 of the cell. The aqueous solution which issues from the anodic compartment via line 78 with the ionic concentration:

| | |
|---|---|
| $fe^{+3}$: | 30 g/l |
| $U^{+4}$: | 0.5 g/l |
| $U^{+6}$: | 4.9 g/l |

is the production solution and is passed to storage for later treatment.

While the invention has been illustrated in the drawings and described in the examples in terms of various preferred embodiments, the skilled artisan will appreciate that various modifications, substitutions, omissions and changes may be made without departing from the spirit thereof. Accordingly, it is intended that the scope of the present invention be limited solely by the scope of the following claims.

What is claimed is:

1. A continuous process for the recovery and concentration of uranium (VI) contained in an organic phase immiscible with water without recovering significant amounts of uranium (IV), which comprises:

(a) treating an organic phase, which is immiscible with water and which contains uranium (VI), in one or a plurality of liquid-liquid contact zones, with an aqueous extraction solution containing a soluble oxidizing-reducing agent in the partially or completely reduced state, said oxidizing-reducing agent being capable of reducing uranium (VI) to uranium (IV) in said aqueous solution, whereby uranium (VI) is reduced and extracted into said aqueous solution in the form of uranium (IV) ions, and wherein said aqueous extraction solution entering the contact zone or zones issues entirely or partially from the cathodic compartment of an electrolytic separation cell under a direct current potential;

(b) separating the organic phase depleted of uranium, and the aqueous phase containing the oxidizing-reducing agent and charged with uranium;

(c) dividing the aqueous phase containing the oxidizing-reducing agent and charged with uranium into two flows;

(d) supplying one of said two flows to the cathodic compartment of an electrolytic cell under a direct current potential, wherein the flow is electrolytically reduced, and then recycling the resultant aqueous flow issuing from said cathodic compartment as the aqueous extraction solution of step (a); and (e) supplying the other of said two flows to the anodic compartment of said electrolytic cell under a direct current potential, wherein the flow is electrolytically oxidized, and then recovering from said anodic compartment the resultant concentrated aqueous phase containing uranium substantially in the form of uranium (VI) and the oxidizing-reducing agent in its oxidized state.

2. A process according to claim 1 wherein a single contact zone is employed.

3. A process according to claim 1 wherein a plurality of contact zones are employed.

4. A process according to claim 2 or 3 wherein a single electrolytic cell is employed.

5. A process according to claim 2 or 3 wherein a plurality of electrolytic cells are employed.

6. A process according to claim 1 wherein the organic phase contains a cationic extractant for the uranium (VI).

7. A process according to claim 6 wherein the cationic extractant comprises at least one acid selected from the group consisting of monoalkylphosphoric acids, dialkylphosphoric acids, alkylphenylphosphoric acids, alkylphosphonic acids, alkylphosphinic acids and alkylpyrophosphoric acids, wherein the alkyl groups each contain 4 to 10 carbon atoms.

8. A process according to claim 7 wherein the organic phase further contains a synergistic extraction agent.

9. A process according to claim 6, 7 or 8 wherein the organic phase further contains, as a diluent, an organic solvent which is inert with respect to the extracting mixture.

10. A process according to claim 9 wherein the diluent is selected from the group consisting of aliphatic hydrocarbons, aromatic hydrocarbons, halogenated hydrocarbons and petroleum ethers.

11. A process according to claim 10 wherein the diluent is kerosene.

12. A process according to claim 6 wherein the cationic extractant is di-(2-ethylhexyl)phosphoric acid.

13. A process according to claim 12 wherein the organic phase further contains a synergistic extraction agent.

14. A process according to claim 12 or 13 wherein the organic phase further contains, as a diluent, an organic solvent which is inert with respect to the extracting mixture.

15. A process according to claim 14 wherein the diluent is selected from the group consisting of aliphatic hydrocarbons, aromatic hydrocarbons, halogenated hydrocarbons and petroleum ethers.

16. A process according to claim 15 wherein the diluent is kerosene.

17. A process according to claim 13 wherein the synergistic extraction agent is trioctylphosphine oxide.

18. A process according to claim 17 wherein the organic phase further contains, as a diluent, an organic solvent which is inert with respect to the extracting mixture.

19. A process according to claim 18 wherein the diluent is selected from the group consisting of aliphatic hydrocarbons, aromatic hydrocarbons, halogenated hydrocarbons and petroleum ethers.

20. A process according to claim 19 wherein the diluent is kerosene.

21. A process according to claim 18, 19 or 20 wherein the concentration of di-(2-ethylhexyl)phosphoric acid in the diluent is between about 0.1 and about 2 mole and the concentration of trioctylphosphine oxide in the diluent is between about 0.01 and about 2 mole.

22. A process according to claim 21 wherein the aqueous extraction solution is a solution of phosphoric acid in which the concentration of phosphoric acid is between 18 and 70% by weight of $P_2O_5$.

23. A process according to claim 1 wherein the organic phase contains an anionic extractant.

24. A process according to claim 23 wherein the anionic extractant is selected from the group consisting of secondary and tertiary amines which are insoluble in water.

25. A process according to claim 1 wherein the organic phase contains a neutral extractant.

26. A process according to claim 25 wherein the neutral extractant is a trialkyl phosphate which is immiscible in water.

27. A process according to claim 1 wherein the concentration of uranium in the organic phase is between 20 and 3000 mg per liter.

28. A process according to claim 27 wherein the concentration of uranium in the organic phase is between 50 and 500 mg per liter.

29. A process according to claim 1 wherein the aqueous extraction solution is a solution of a strong acid which complexes uranium and which is selected from the group consisting of phosphoric, hydrochloric and sulfuric acids.

30. A process according to claim 12, 13, 17, 18, 19 or 20 wherein the aqueous extraction solution is a solution of phosphoric acid in which the concentration of phosphoric acid is between 18 and 70% by weight of $P_2O_5$.

31. A process according to claim 1 wherein the oxidizing-reducing agent in the reduced state which is present in the aqueous extraction solution comprises iron (II) ions.

32. A process according to claim 31 wherein the iron (II) ions are present in an amount between 0.5 and 100 g per liter of aqueous solution.

33. A process according to claim 1 wherein the process is conducted at a temperature between about 20° and 80° C.

34. A process according to claim 33 wherein the temperature is between about 50° and 55° C.

35. A process according to claim 1 wherein the ratio of the flow rate of the organic phase to that of the aqueous solution is between 20 and 50.

36. A process according to claim 1 wherein a fraction of the aqueous phase issuing from the contact zone or zones is recycled into said contact zone or zones.

37. A process according to claim 36 wherein the contact zone or zones are equipped with internal recirculation of the aqueous phase at a ratio of recycled aqueous phase to organic phase of between about 0.1 to 10.

38. A process according to claim 37 wherein the ratio of recycled aqueous phase to organic phase is between about 0.5 and 2.

39. A process according to claim 1 wherein the electrolytic separation cell has a separator comprising a perfluorated sulfonic polymer membrane.

40. A process according to claim 1 wherein the recovered concentrated aqueous phase containing uranium substantially in the form of uranium (VI) is further treated with a chemical oxidizing agent in an amount sufficient to convert residual uranium (IV) to uranium (VI).

41. A process according to claim 1 wherein the aqueous extraction solution is a solution of strong acid which complexes uranium and which is selected from the group consisting of phosphoric, hydrochloric and sulfuric acids, and wherein, after step (c), the flow being supplied to the cathodic compartment of said electrolytic cell is combined, prior to its entry into said cathodic compartment, with an aqueous flow containing the strong, complexing acid and the oxidizing-reducing agent, in amounts corresponding to those withdrawn in the flow being supplied to the anodic compartment of said electrolytic cell.

* * * * *

UNITED STATES PATENT AND TRADEMARK OFFICE

CERTIFICATE OF CORRECTION

PATENT NO. : 4,341,602

DATED : July 27, 1982

INVENTOR(S) : Thomas NENNER and Dominique FORAISON

It is certified that error appears in the above—identified patent and that said Letters Patent is hereby corrected as shown below:

Cover page, left column, part [54], line 3 of the title, change "BATH" to --BOTH--; and Column 1, line 4, change "BATH" to --BOTH--.

Signed and Sealed this

*Fifth* Day of *October 198*

[SEAL]

*Attest:*

GERALD J. MOSSINGHOFF

*Attesting Officer*

*Commissioner of Patents and Trademarks*